US010808925B2

(12) United States Patent
Karkow et al.

(10) Patent No.: US 10,808,925 B2
(45) Date of Patent: Oct. 20, 2020

(54) METHOD FOR ELECTRICALLY CONTROLLED COMBUSTION FLUID FLOW

(71) Applicant: CLEARSIGN COMBUSTION CORPORATION, Seattle, WA (US)

(72) Inventors: Douglas W. Karkow, Manchester, IA (US); Christopher A. Wiklof, Everett, WA (US)

(73) Assignee: CLEARSIGN TECHNOLOGIES CORPORATION, Seattle, WA (US)

( * ) Notice: Subject to any disclaimer, the term of this patent is extended or adjusted under 35 U.S.C. 154(b) by 92 days.

(21) Appl. No.: 16/217,913

(22) Filed: Dec. 12, 2018

(65) Prior Publication Data

US 2019/0113224 A1 Apr. 18, 2019

Related U.S. Application Data

(62) Division of application No. 14/772,033, filed as application No. PCT/US2014/031969 on Mar. 27, 2014, now Pat. No. 10,190,767.

(Continued)

(51) Int. Cl.

*F23C 99/00* (2006.01)
*F23Q 7/06* (2006.01)

(Continued)

(52) U.S. Cl.

CPC ..... *F23C 99/001* (2013.01); *F23D 14/84* (2013.01); *F23N 5/123* (2013.01); *F23Q 7/06* (2013.01); *F23D 2208/00* (2013.01)

(58) Field of Classification Search

CPC ..... F23C 99/001; F23D 14/14; F23D 14/145; F23D 2203/102; F23D 2203/103; F23D 2203/104; F23N 5/265

(Continued)

(56) References Cited

U.S. PATENT DOCUMENTS 2,604,936 A 7/1952 Kaehni et al.
3,008,513 A 11/1961 Holden (Continued)

FOREIGN PATENT DOCUMENTS

EP 0844434 5/1998
EP 1139020 8/2006

(Continued)

OTHER PUBLICATIONS

Timothy J.C. Dolmansley et al., "Electrical Modification of Combustion and the Affect of Electrode Geometry on the Field Produced," Modelling and Simulation in Engineering, May 26, 2011, 1-13, vol. 2011, Himdawi Publishing Corporation.

(Continued)

*Primary Examiner* — Vivek K Shirsat

(74) *Attorney, Agent, or Firm* — Christopher A. Wiklof; James C. Larsen; Launchpad IP, Inc.

(57) ABSTRACT

A combustion fluid flow barrier includes an aperture to control combustion fluid flow. The combustion fluid is charged by a charge generator. The combustion fluid flow barrier includes at least one flow control electrode operatively coupled to the aperture and configured to selectively allow, attract, or resist passage of the charged combustion fluid through the aperture, depending on voltage applied to the flow control electrode.

13 Claims, 9 Drawing Sheets

Related U.S. Application Data

(60) Provisional application No. 61/805,924, filed on Mar. 27, 2013.

(51) Int. Cl.
*F23N 5/12* (2006.01)
*F23D 14/84* (2006.01)

(58) Field of Classification Search
USPC ..... 431/7–8, 326–329, 258, 356, 354
See application file for complete search history.

(56) References Cited

U.S. PATENT DOCUMENTS 3,167,109 A 1/1965 Wobig
3,224,485 A 12/1965 Blomgren et al.
3,228,614 A 1/1966 Bauer
3,269,446 A 8/1966 Luther
3,306,338 A 2/1967 Wright et al.
3,358,731 A 12/1967 Donnelly
3,416,870 A 12/1968 Wright
3,488,544 A 1/1970 Burley et al.
3,749,545 A 7/1973 Velkoff
3,841,824 A * 10/1974 Bethel ..... F23C 99/001 431/8
4,020,388 A 4/1977 Pratt, Jr.
4,021,188 A 5/1977 Yamagishi et al.
4,081,958 A 4/1978 Schelp
4,093,430 A 6/1978 Schwab et al.
4,111,636 A 9/1978 Goldberg
4,176,637 A 12/1979 Cole
4,201,140 A 5/1980 Robinson
4,362,016 A 12/1982 Papadopulos
4,363,208 A 12/1982 Hoffman et al.
4,397,356 A 8/1983 Retallick
4,408,461 A 10/1983 Bruhwiler et al.
4,430,024 A 2/1984 Guild et al.
4,473,349 A 9/1984 Kumatsu
4,673,349 A 1/1987 Abe et al.
4,643,667 A 2/1987 Fleming
4,675,029 A 6/1987 Norman et al.
4,726,767 A 2/1988 Nakajima
4,752,213 A 6/1988 Grochowski et al.
4,899,696 A 2/1990 Kennedy et al.
5,235,667 A 8/1993 Canfield et al.
5,248,255 A 9/1993 Morioka et al.
5,288,303 A 2/1994 Woracek et al.
5,300,270 A 4/1994 Krigmont et al.
5,326,257 A 7/1994 Taylor et al.
5,380,192 A 1/1995 Hamos
5,439,372 A 8/1995 Duret et al.
5,441,402 A 8/1995 Reuther et al.
5,511,516 A 4/1996 Moore, Jr. et al.
5,515,681 A 5/1996 DeFreitas
5,702,244 A 12/1997 Goodson et al.
5,784,889 A 7/1998 Joos et al.
5,899,686 A 5/1999 Carbone et al.
6,065,963 A 5/2000 Dewaegheneire et al.
6,095,798 A 8/2000 Mitani et al.
6,211,490 B1 4/2001 Nosse
7,137,808 B2 11/2006 Branston et al.
7,243,496 B2 7/2007 Pavlik et al.
7,523,603 B2 4/2009 Hagen et al.
7,837,962 B2 11/2010 Eiteneer et al.
8,245,951 B2 8/2012 Fink et al.
8,851,882 B2 10/2014 Hartwick et al.
8,881,535 B2 11/2014 Hartwick et al.
8,911,699 B2 12/2014 Colannino et al.
9,062,882 B2 6/2015 Hangauer et al.
9,209,654 B2 12/2015 Colannino et al.
9,267,680 B2 2/2016 Goodson et al.
9,284,886 B2 3/2016 Breidenthal et al.
9,289,780 B2 3/2016 Goodson
9,310,077 B2 4/2016 Breidenthal et al.
9,366,427 B2 6/2016 Sonnichsen et al.
9,371,994 B2 6/2016 Goodson et al.
9,377,188 B2 6/2016 Ruiz et al.
9,377,189 B2 6/2016 Ruiz et al.
9,377,190 B2 6/2016 Karkow et al.
9,377,195 B2 6/2016 Goodson et al.
9,388,981 B2 7/2016 Karkow et al.
2002/0088442 A1 7/2002 Hansen et al.
2002/0092302 A1 7/2002 Johnson et al.
2002/0155403 A1 10/2002 Griffin et al.
2002/0197574 A1* 12/2002 Jones ..... F23D 14/02 431/8
2004/0081933 A1 4/2004 St. Charles et al.
2005/0208442 A1 9/2005 Heiligers et al.
2005/0208446 A1 9/2005 Jayne
2006/0165555 A1 7/2006 Spielman et al.
2007/0020567 A1 1/2007 Branston et al.
2007/0071657 A1 3/2007 Okubo et al.
2007/0186872 A1 8/2007 Shellenberger et al.
2008/0145802 A1 6/2008 Hammer et al.
2008/0268387 A1 10/2008 Saito et al.
2009/0056923 A1 3/2009 Lin
2010/0178219 A1 7/2010 Verykios et al.
2011/0027734 A1* 2/2011 Hartwick ..... F02P 11/06 431/264
2011/0072786 A1 3/2011 Tokuda et al.
2011/0076628 A1 3/2011 Miura et al.
2011/0203771 A1 8/2011 Goodson et al.
2012/0135360 A1 5/2012 Hannum et al.
2012/0164590 A1 6/2012 Mach
2013/0004902 A1 1/2013 Goodson et al.
2013/0071794 A1 3/2013 Colannino et al.
2013/0230810 A1 9/2013 Goodson et al.
2013/0260321 A1 10/2013 Colannino et al.
2013/0291552 A1 11/2013 Smith et al.
2013/0323655 A1 12/2013 Krichtafovitch et al.
2013/0323661 A1 12/2013 Goodson et al.
2013/0333279 A1 12/2013 Osler et al.
2013/0336352 A1 12/2013 Colannino et al.
2014/0051030 A1 2/2014 Colannino et al.
2014/0065558 A1 3/2014 Colannino et al.
2014/0076212 A1 3/2014 Goodson et al.
2014/0080070 A1 3/2014 Krichtafovitch et al.
2014/0162195 A1 6/2014 Lee et al.
2014/0162196 A1 6/2014 Krichtafovitch et al.
2014/0162197 A1 6/2014 Krichtafovitch et al.
2014/0162198 A1 6/2014 Krichtafovitch et al.
2014/0170569 A1 6/2014 Anderson et al.
2014/0170571 A1 6/2014 Casasanta, III et al.
2014/0170575 A1 6/2014 Krichtafovitch
2014/0170576 A1 6/2014 Colannino et al.
2014/0170577 A1 6/2014 Colannino et al.
2014/0186778 A1 7/2014 Colannino et al.
2014/0196368 A1 7/2014 Wiklof
2014/0196369 A1 7/2014 Wiklof
2014/0208758 A1 7/2014 Breidenthal et al.
2014/0212820 A1 7/2014 Colannino et al.
2014/0216401 A1 8/2014 Colannino et al.
2014/0227645 A1 8/2014 Krichtafovitch et al.
2014/0227646 A1 8/2014 Krichtafovitch et al.
2014/0227649 A1 8/2014 Krichtafovitch et al.
2014/0248566 A1 9/2014 Krichtafovitch et al.
2014/0255855 A1 9/2014 Krichtafovitch
2014/0255856 A1 9/2014 Colannino et al.
2014/0272730 A1 9/2014 Krichtafovitch et al.
2014/0272731 A1 9/2014 Breidenthal et al.
2014/0287368 A1 9/2014 Krichtafovitch et al.
2014/0295094 A1 10/2014 Casasanta, III
2014/0295360 A1 10/2014 Wiklof
2014/0335460 A1 11/2014 Wiklof et al.
2015/0079524 A1 3/2015 Colannino et al.
2015/0104748 A1 4/2015 Dumas et al.
2015/0107260 A1 4/2015 Colannino et al.
2015/0121890 A1 5/2015 Colannino et al.
2015/0140498 A1 5/2015 Colannino
2015/0147704 A1 5/2015 Krichtafovitch et al.
2015/0147705 A1 5/2015 Colannino et al.
2015/0147706 A1 5/2015 Krichtafovitch et al.
2015/0219333 A1 8/2015 Colannino et al.
2015/0226424 A1 8/2015 Breidenthal et al.

(56) References Cited

U.S. PATENT DOCUMENTS

| | | | |
|---|---|---|---|
| 2015/0241057 | A1 | 8/2015 | Krichtafovitch et al. |
| 2015/0276211 | A1 | 10/2015 | Colannino et al. |
| 2015/0276217 | A1 | 10/2015 | Karkow et al. |
| 2015/0276220 | A1 | 10/2015 | Karkow et al. |
| 2015/0285491 | A1 | 10/2015 | Karkow et al. |
| 2015/0316261 | A1 | 11/2015 | Karkow et al. |
| 2015/0330625 | A1 | 11/2015 | Karkow et al. |
| 2015/0338089 | A1 | 11/2015 | Krichtafovitch et al. |
| 2015/0345780 | A1 | 12/2015 | Krichtafovitch |
| 2015/0345781 | A1 | 12/2015 | Krichtafovitch et al. |
| 2015/0362178 | A1 | 12/2015 | Karkow et al. |
| 2015/0369477 | A1 | 12/2015 | Karkow et al. |
| 2016/0025333 | A1 | 1/2016 | Karkow et al. |
| 2016/0033125 | A1 | 2/2016 | Krichtafovitch et al. |
| 2016/0040872 | A1 | 2/2016 | Colannino et al. |
| 2016/0091200 | A1 | 3/2016 | Colannino et al. |
| 2016/0123576 | A1 | 5/2016 | Colannino et al. |
| 2016/0138800 | A1 | 5/2016 | Anderson et al. |
| 2016/0161110 | A1 | 6/2016 | Krichtafovitch et al. |
| 2016/0161115 | A1 | 6/2016 | Krichtafovitch et al. |
| 2016/0175851 | A1 | 6/2016 | Colannino et al. |
| 2016/0215974 | A1 | 7/2016 | Wiklof |

FOREIGN PATENT DOCUMENTS

| | | |
|---|---|---|
| EP | 2738460 | 6/2014 |
| FR | 2577304 | 12/1989 |
| GB | 1042014 | 9/1966 |
| GB | 2456861 | 7/2009 |
| JP | 58-019609 | 2/1983 |
| JP | 60-216111 | 10/1985 |
| JP | 61-265404 | 11/1986 |
| JP | H 07-48136 | 2/1995 |
| JP | 2001-021110 | 1/2001 |
| JP | 2001-033040 | 2/2001 |
| JP | 2001-056120 | 2/2001 |
| WO | WO 1995/000803 | 1/1995 |
| WO | WO 1996/001394 | 1/1996 |
| WO | WO 2015/042566 | 3/2010 |
| WO | WO 2015/123149 | 8/2010 |
| WO | WO 2015/123701 | 8/2010 |
| WO | WO 2013/181569 | 12/2013 |
| WO | WO 2015/017084 | 2/2015 |
| WO | WO 2015/042614 | 3/2015 |
| WO | WO 2015/042615 | 3/2015 |
| WO | WO 2015/051136 | 4/2015 |
| WO | WO 2015/054323 | 4/2015 |
| WO | WO 2015/057740 | 4/2015 |
| WO | WO 2015/061760 | 4/2015 |
| WO | WO 2015/070188 | 5/2015 |
| WO | WO 2015/089306 | 6/2015 |
| WO | WO 2015/103436 | 7/2015 |
| WO | WO 2015/112950 | 7/2015 |
| WO | WO 2015/123381 | 8/2015 |
| WO | WO 2015/123670 | 8/2015 |
| WO | WO 2015/123683 | 8/2015 |
| WO | WO 2015/123694 | 8/2015 |
| WO | WO 2015/123696 | 8/2015 |

OTHER PUBLICATIONS

James Lawton and Felix J. Weinberg. "Electrical Aspects of Combustion." Clarendon Press, Oxford. 1969, p. 158.

M. Zake et al., "Electric Field Control of NOx Formation in the Flame Channel Flows." Global Nest: The Int. J. May 2000, vol. 2, No. 1, pp. 99-108.

PCT International Search Report and Written Opinion of International PCT Application No. PCT/US2014/031969 dated Aug. 19, 2014.

James Lawton et al., Electrical Aspects of Combustion, 1969, p. 81, 296, Clarendon Press, Oxford, England.

Arnold Schwarzenegger, A Low NOx Porous Ceramics Burner Performance Study, California Energy Commission Public Interest Energy Research Program, Dec. 2007, 6, 24, San Diego State University Foundation.

Takeno, Abstract, Combustion Institute 1982, 1 page.

* cited by examiner

METHOD FOR ELECTRICALLY CONTROLLED COMBUSTION FLUID FLOW

CROSS REFERENCE TO RELATED APPLICATION

The present application is a Divisional of U.S. patent application Ser. No. 14/772,033, entitled "ELECTRICALLY CONTROLLED COMBUSTION FLUID FLOW", filed Sep. 1, 2015. U.S. patent application Ser. No. 14/772,033 is a U.S. National Phase application under 35 U.S.C. § 371 of International PCT Patent Application No. PCT/US2014/031969, entitled "ELECTRICALLY CONTROLLED COMBUSTION FLUID FLOW", filed Mar. 27, 2014, now expired. International PCT Patent Application No. PCT/US2014/031969 claims priority benefit from U.S. Provisional Patent Application No. 61/805,924, entitled "ELECTRICALLY CONTROLLED COMBUSTION FLUID FLOW", filed Mar. 27, 2013, now expired. Each of the foregoing applications, to the extent not inconsistent with the disclosure herein, is incorporated by reference.

SUMMARY

According to an embodiment, a system for electrically controlling combustion fluid flow includes a charge generator configured to apply a charge or voltage to a combustion fluid flow corresponding to a combustion reaction, a combustion fluid flow barrier defining at least one aperture therethrough, at least one flow control electrode operatively coupled to the at least one aperture, a voltage source operatively coupled to the flow control electrode, and a controller configured to control an application of one or more voltages from the voltage source to the flow control electrode.

According to an embodiment, a method for electrically controlling combustion fluid flow includes outputting electrical charges to a combustion fluid to form a charged combustion fluid, supporting a body defining a plurality of apertures aligned to receive a flow of the charged combustion fluid, applying a control voltage to a control electrode disposed adjacent to the plurality of apertures, and affecting a flow of the charged combustion fluid through the plurality of apertures with an electrical interaction between the charged combustion fluid and the control voltage carried by the control electrode.

DETAILED DESCRIPTION

Figure 1A:
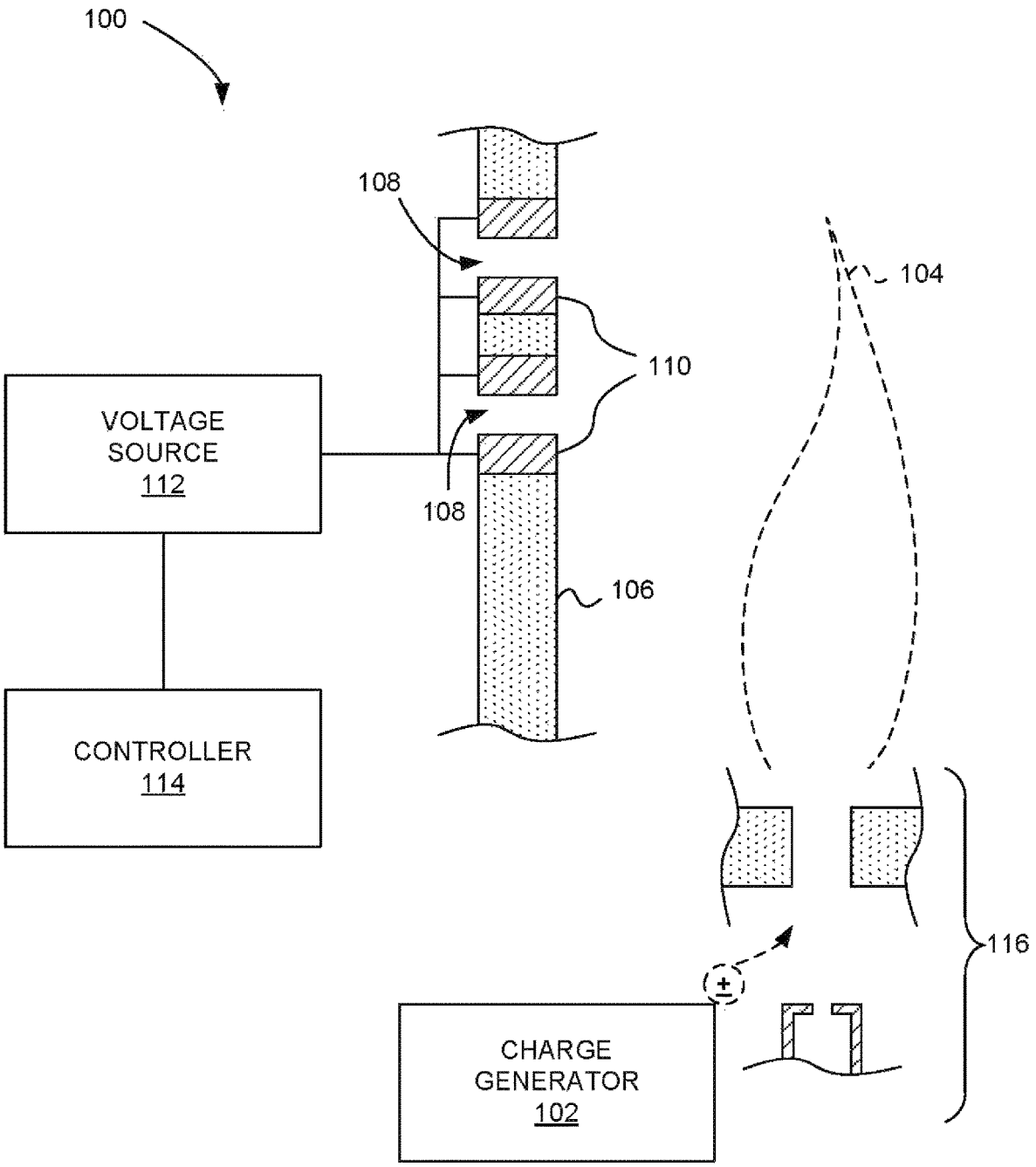
FIG. 1A is a diagram of a system for electrically controlling combustion fluid flow, according to an embodiment.

In the following detailed description, reference is made to the accompanying drawings, which form a part hereof. In the drawings, similar symbols typically identify similar components, unless context dictates otherwise. Other embodiments may be used and/or other changes may be made without departing from the spirit or scope of the disclosure.

Figure 1B:
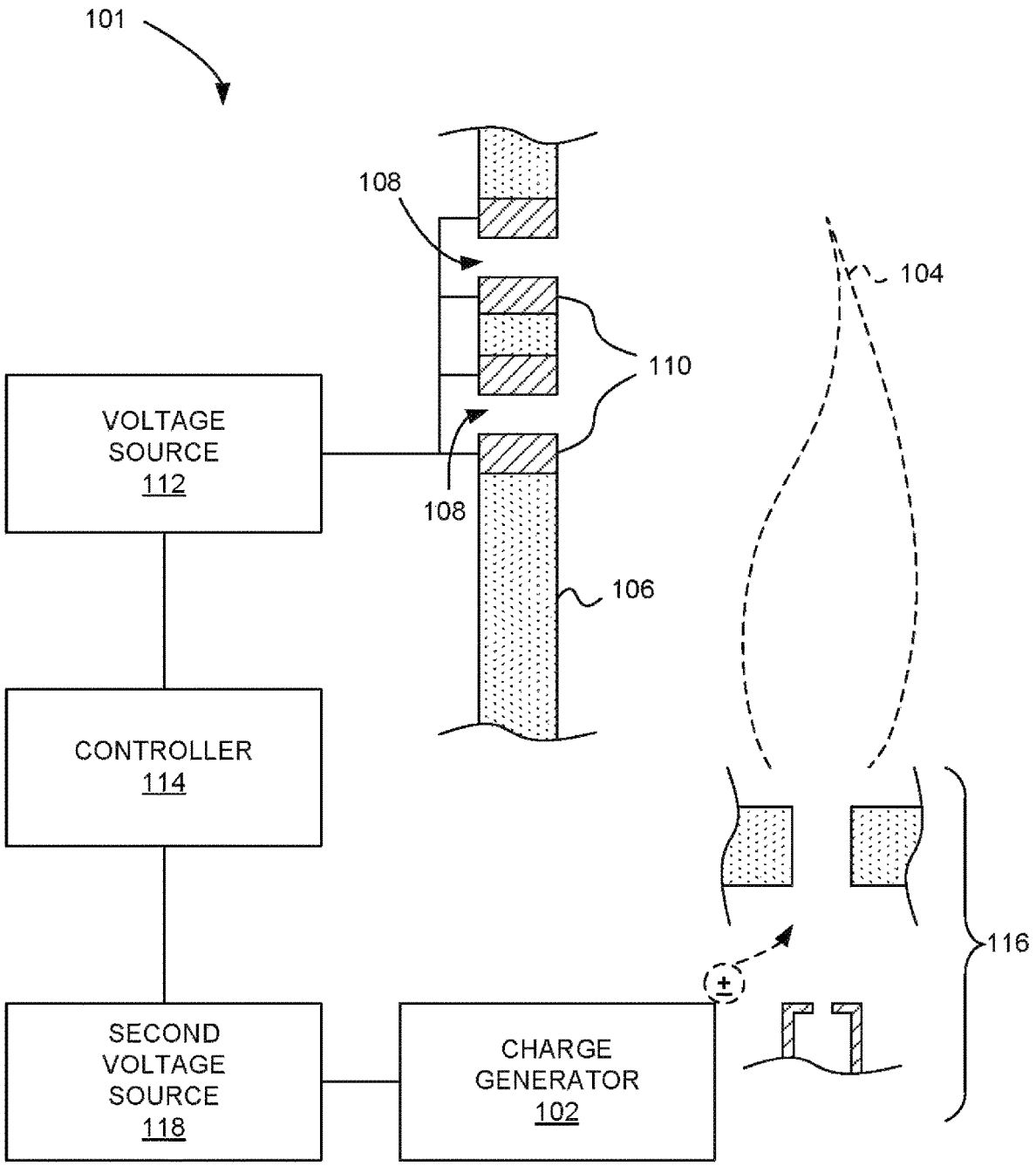
FIG. 1B is a diagram of a system for electrically controlling combustion fluid flow, according to another embodiment.
Figure 2:
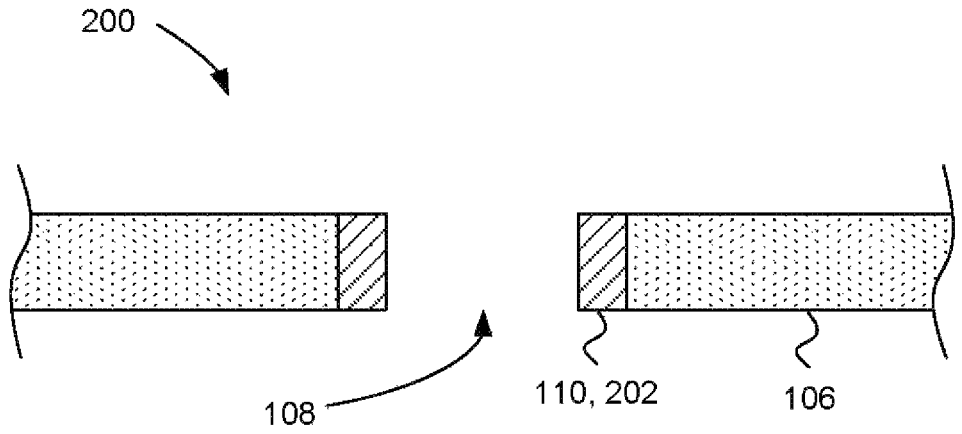
FIG. 2 is a diagram of a flow control electrode including a tube defining an aperture, according to an embodiment.
Figure 3:
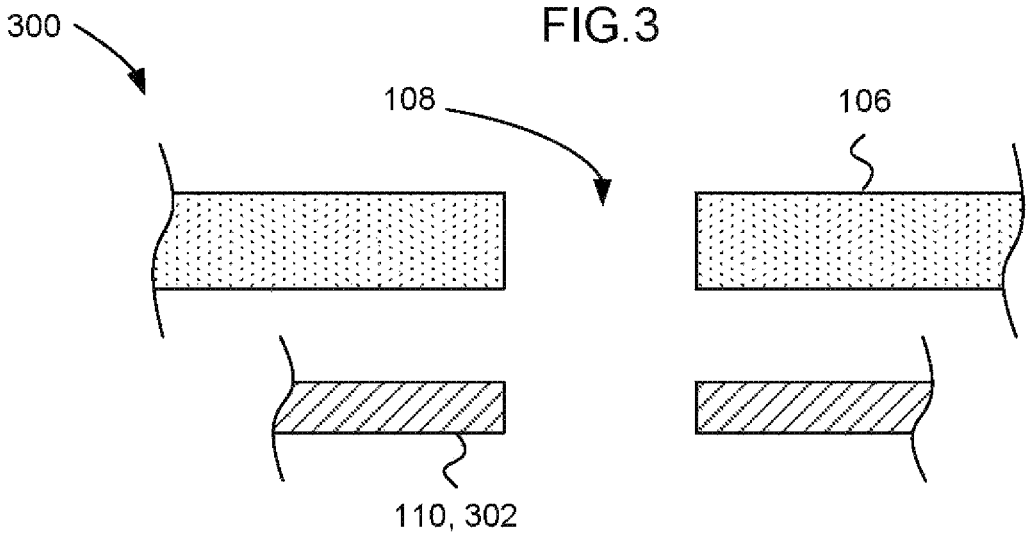
FIG. 3 is a diagram of a flow control electrode including a plate disposed adjacent to an aperture, according to an embodiment.
Figure 4:
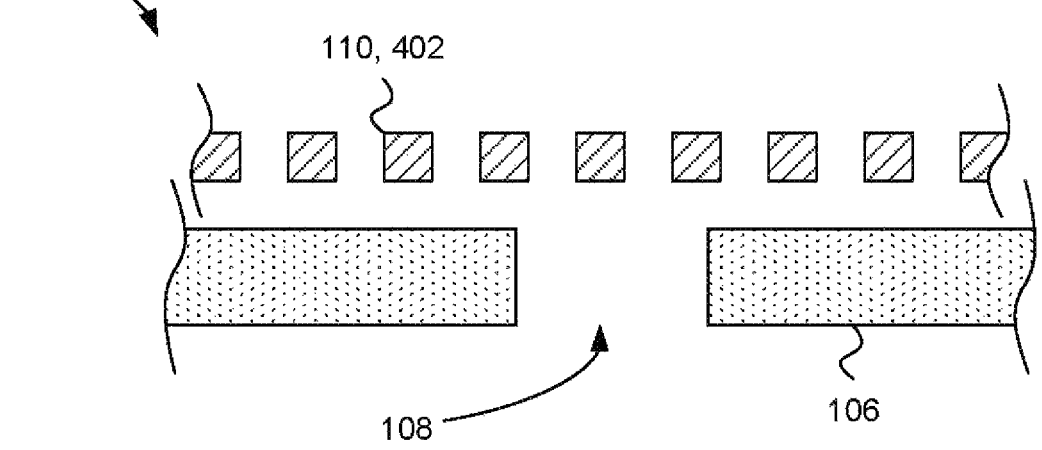
FIG. 4 is a diagram of a flow control electrode including a mesh disposed adjacent to an aperture, according to an embodiment.
Figure 5:
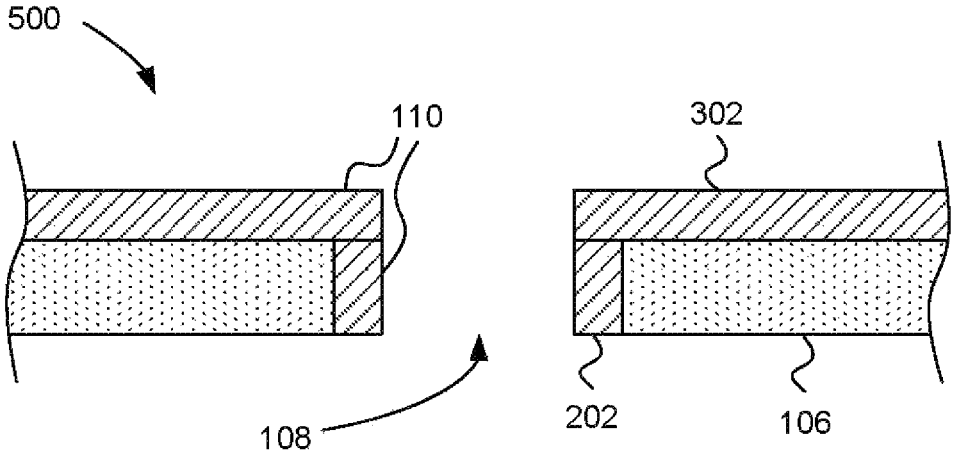
FIG. 5 is a diagram of a flow control electrode including a plate and a tube in electrical communication with the plate, according to an embodiment.
Figure 6:
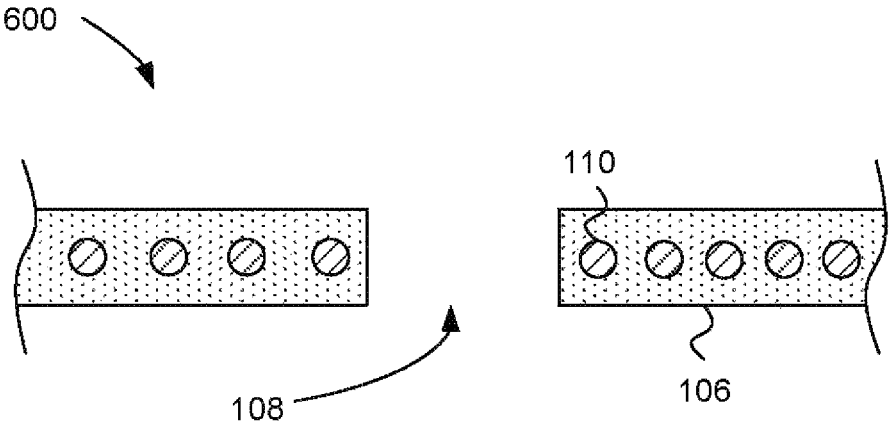
FIG. 6 is a diagram of a flow control electrode embedded in a combustion fluid flow barrier, according to an embodiment.

FIGS. 1A and 1B are diagrams of a system 100, 101 for electrically controlling combustion fluid flow. The system 100, 101 includes a charge generator 102 configured to apply a charge or voltage to a combustion fluid flow corresponding to a combustion reaction 104. A combustion fluid flow barrier 106 defines at least one aperture 108 therethrough. According to embodiments, the combustion fluid flow barrier 106 can include a body that defines a plurality of apertures and which forms a perforated flame holder or perforated reaction holder, wherein the plurality of apertures are configured to collectively carry the combustion reaction 104.

Various embodiments of bodies defining apertures configured to collectively carry a combustion reaction are contemplated. Some contemplated embodiments are described in International PCT Patent Application No. PCT/US2014/016626 entitled "SELECTABLE DILUTION LOW NOx BURNER" filed on Feb. 14, 2014, International PCT Patent Application No. PCT/US2014/016628 entitled "PERFORATED FLAME HOLDER AND BURNER INCLUDING A PERFORATED FLAME HOLDER" filed on Feb. 14, 2014, International PCT Patent Application No. PCT/US2014/016632 entitled "FUEL COMBUSTION SYSTEM WITH A PERFORATED REACTION HOLDER" filed on Feb. 14, 2014 and International PCT Patent Application No. PCT/US14/16622 entitled "STARTUP METHOD AND MECHANISM FOR A BURNER HAVING A PERFORATED FLAME HOLDER" filed on Feb. 14, 2014; each of which, to the extent not inconsistent with the disclosure herein, is incorporated by reference.

At least one flow control electrode 110 is operatively coupled to the at least one aperture 108. A voltage source 112 is operatively coupled to the flow control electrode 110. A controller 114 is configured to control an application of one or more voltages from the voltage source 112 to the flow control electrode 110. According to an embodiment, the system 100, 101 includes a burner 116.

The charge generator 102 can be configured to apply a charge or voltage at a first polarity to the combustion fluid flow. The controller 114 can be configured to cause the voltage source 112 to apply a voltage at the first polarity to the flow control electrode 110 to impede flow of the combustion fluid flow through the at least one aperture 108. Additionally or alternatively, the controller 114 can be configured to cause the voltage source 112 to not apply a voltage to the flow control electrode 110 to allow flow of the combustion fluid flow through the at least one aperture 108, can be configured to cause the voltage source 112 to hold the flow control electrode 110 at voltage ground to attract flow of the combustion fluid flow through the at least one aperture 108 and/or can be configured to cause the voltage source 112 to apply a voltage at a second polarity opposite from the first polarity to the flow control electrode 110 to attract flow of the combustion fluid flow through the at least one aperture 108.

Referring to FIG. 1B, according to an embodiment, the controller 114 is configured to control the application of charge or voltage to the combustion fluid flow by the charge generator 102. A second voltage source 118 can be operatively coupled to the charge generator 102. The controller 114 can also be operatively coupled to the second voltage source 118. The controller 114 can be configured to control the application of voltage from the second voltage source 118 to the charge generator 102.

Referring to FIGS. 1A and 1B, the at least one aperture 108 can include a plurality of apertures 108. The at least one flow control electrode 110 can be configured to control combustion fluid flow through the plurality of apertures 108. The plurality of apertures can be configured to collectively hold a combustion reaction, with the flow control electrode (s) being configured to affect the flow rate of fuel and air (examples of combustion fluids) through the plurality of apertures 108. The flow control electrode 110 can include an electrical conductor. According to another embodiment, the flow control electrode 110 can include a semiconductor. The flow control electrode 110 can be configured to control passage of various combustion fluids through the aperture 108. For example, the flow control electrode 110 may control passage of a flame, flue gas, and/or combustion air through the aperture 108.

FIGS. 2-6 are diagrams of flow electrodes 110 according to various embodiments. Referring to the embodiment 200 of FIG. 2, the flow control electrode 110 can include a tube 202 defining the aperture 108. Referring to the embodiment 300 of FIG. 3, the flow control electrode 110 can include a plate 302 disposed adjacent to the aperture 108. Referring to the embodiment 400 of FIG. 4, the flow control electrode 110 can include a mesh 402 disposed adjacent to the aperture 108. Referring to the embodiment 500 of FIG. 5, the flow control electrode 110 can include a plate 302 and a tube 202 in electrical communication with the plate 302. The tube 202 can define the aperture 108. Referring to the embodiment 600 of FIG. 6, the flow control electrode 110 can be embedded in the combustion fluid flow barrier 106.

Optionally, a counter-electrode can be arranged relative to an energized electrode to cause a flow or counter-flow of ionic wind through the aperture(s) 108. For example, the electrode 202 of FIG. 2 can be combined with an electrode 302, 402, shown respectively in FIGS. 3 and 4, to form an electrode/counter-electrode pair. Similarly, the electrode 302 of FIG. 3 can be combined with the electrode 402 of FIG. 4 as an electrode/counter-electrode pair. The relative potentials of an electrode/counter-electrode pair may be interchangeable and may be selected to enhance flow (and thereby entrainment of combustion fluid) through the aperture 108 or to restrict flow (e.g., by "blowing upstream") of combustion fluid through the aperture 108. Optionally one of the electrodes may be configured as an ion-emitting (corona) electrode to increase ion density above the ion density provided by a charge generator 102.

Figure 7:
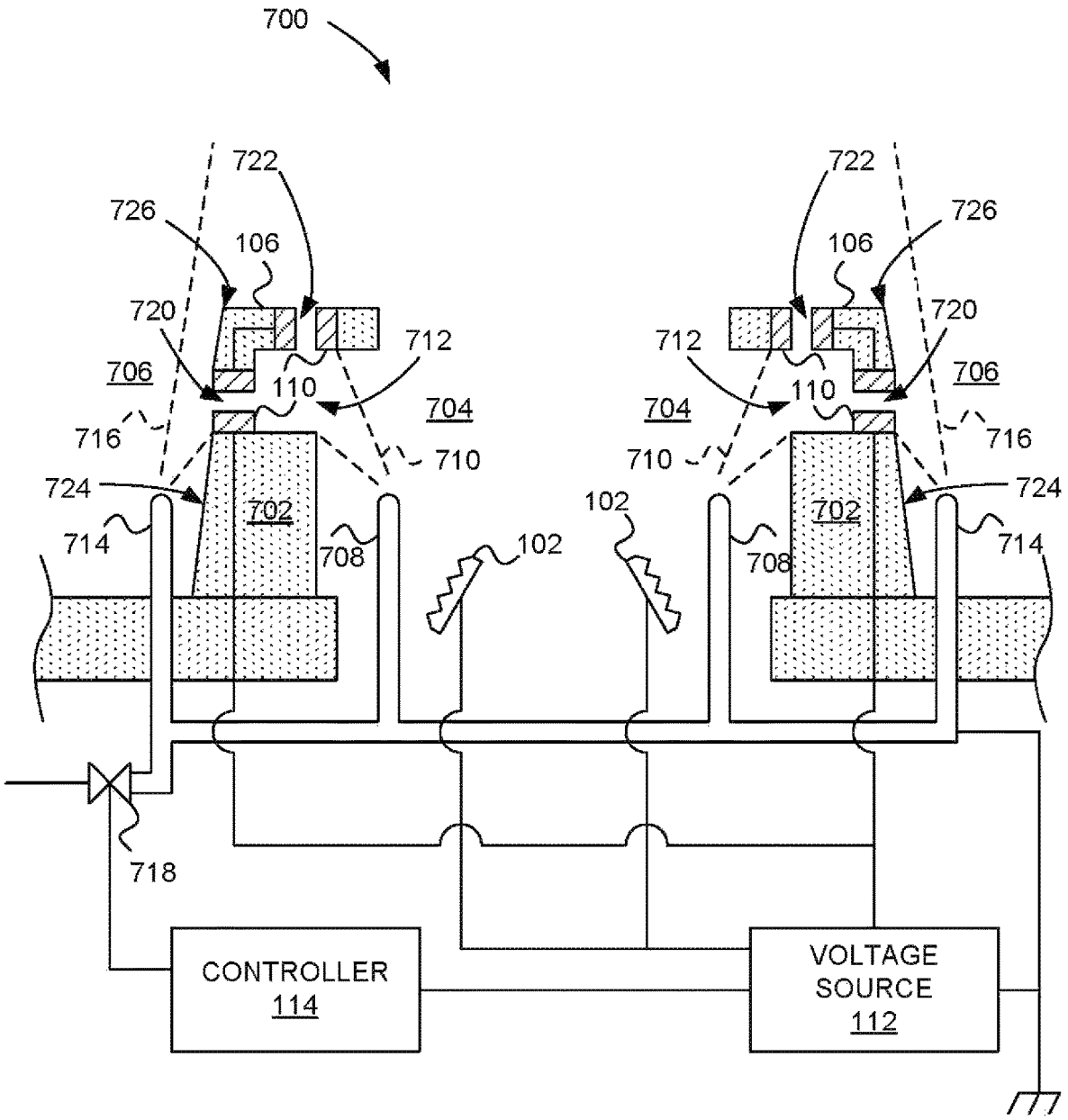
FIG. 7 is a diagram of a combustion fluid flow barrier formed as a flame barrier, according to an embodiment.

FIG. 7 is a diagram of a combustion fluid flow barrier 106 formed as a flame barrier 702 configured to separate a primary combustion region 704 from a secondary combustion region 706, according to an embodiment 700. The primary combustion region 704 receives primary fuel from a primary fuel nozzle 708 configured to output a primary fuel jet 710 toward the flame barrier 702. A primary combustion reaction can occur in a region including a groove 712 contiguous with the primary combustion region 704. For example, the primary combustion reaction can act as heat source for igniting a secondary combustion reaction. The secondary combustion region 706 can receive secondary fuel from a secondary fuel nozzle 714 configured to output a secondary fuel jet 716 to at least partially impinge on the flame barrier 702. Fuel flow to the primary and secondary fuel nozzles 708, 714 can be controlled or measured by a fuel valve or flow sensor 718. The fuel valve or flow sensor 718 can be operatively coupled to a controller 114 configured to control fuel flow via an actuated fuel valve 718 or to receive fuel flow data from a fuel flow sensor 718.

A plurality of apertures 108 form passages 720, 722 between the primary combustion region 704 and the secondary combustion region 706. According to an embodiment, passage(s) 720 between the primary combustion region 704 and the secondary combustion region 706 provide selective heat communication between the groove 712 or a surface adjacent to the primary combustion region 704 and a substantially vertical surface 724 of the flame barrier 702. According to another embodiment, a passage 722 between the primary combustion region 704 and the secondary combustion region 706 provides selective communication between the primary combustion region 704 and a substantially horizontal surface 726 of the flame barrier 702. The substantially horizontal surface 726 can act as a secondary flame holding surface. Embodiments can include both horizontal passages 720 and vertical passages 722.

In the embodiment 700, the flow control electrode(s) 110 is configured to control ignition in the secondary combustion region 706.

The combustion fluid flow barrier 106 can include a bluff body configured to selectively support a flame (corresponding to the secondary combustion reaction, not shown). The flow control electrode 110 is configured to cause the flame to be supported by the bluff body when the combustion fluid is attracted or allowed to flow through the at least one aperture 108, 720, 722. The flow control electrode 110 is also configured to cause the flame to not be supported by the bluff body when the combustion fluid is impeded from flowing through the at least one aperture 108, 720, 722. In operation, a charge generator 102 is energized by the voltage source 112 to cause the primary combustion reaction to carry a charge or voltage at a first polarity. During start-up, for example, the flow control electrodes can be raised to a voltage having a second polarity opposite to the first polarity to cause flames from the primary combustion reaction to flow through the aperture(s) 108, 720, 722 to ignite a secondary combustion reaction proximate to the combustion fluid barrier 702 and to be held by the surface 726. After the system is warmed up, it may be desirable to ignite the secondary combustion reaction at a different location. For example, delaying ignition can allow greater secondary fuel dilution, which can result in lower oxides of nitrogen (NOx) output. To delay ignition, the controller 114 can cause the voltage source 112 to electrically energize the flow control electrode(s) 110 to a voltage having the same polarity as the charge applied to the primary combustion reaction by the charge generator(s) 102. Applying a repelling voltage to the flow control electrode(s) 110 can act to effectively increase resistance to combustion fluid (in this case, flame) flow through the aperture(s) 720, 722, thus reducing the probability of the primary combustion reaction delivering sufficient heat to the secondary combustion reaction to ignite the secondary combustion reaction proximate the surfaces 724, 726 of the flame barrier 702.

According to embodiments, the charge polarity placed on the primary combustion reaction by the charge generator(s) 102 can include an alternating charge. The flow control electrode(s) 110 can operate similarly to the description above by placing an in-phase voltage on the flow control electrode(s) 110 to reduce primary flame penetration of the flame barrier 702, or by placing an approximately 180° out-of-phase voltage on the flow control electrode(s) 110 to increase primary flame penetration of the flame barrier 702.

Figure 8:
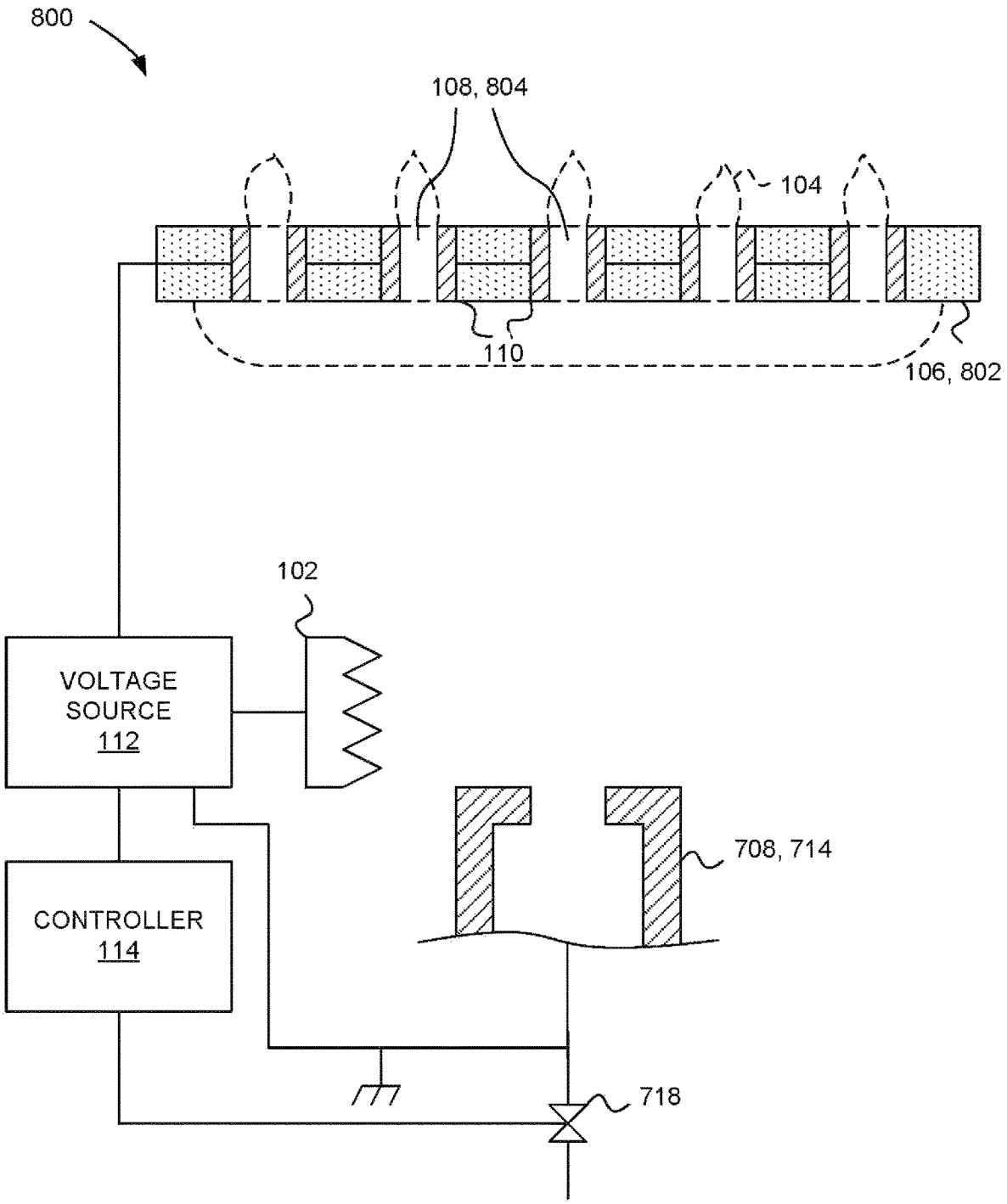
FIG. 8 is a diagram of a combustion fluid flow barrier formed as a perforated flame holder, according to an embodiment.

FIG. 8 is a diagram of an embodiment 800 wherein the combustion fluid flow barrier 106 includes a perforated flame holder 802 configured to hold a flame corresponding to the combustion reaction 104, according to an embodiment. For example, the perforated flame holder 802 of the embodiment 800 can be combined with the embodiment 700 shown in FIG. 7 by supporting the perforated flame holder 802 above the flame barrier 702. The perforated flame holder 802 was found to support a lower NOx-output combustion reaction than a combustion reaction held by the top surface 726 of the flame barrier 702.

The at least one aperture 108 can include a plurality of perforations 804 defined by the perforated flame holder 802. The controller 114 can be configured to cause the at least one flow control electrode 110 to selectively impede combustion fluid flow through the plurality of perforations 804 to cause the flame to be held at the edges of the perforated flame holder 802, and can also be configured to cause the at least one flow control electrode 110 to selectively allow or attract combustion fluid flow through the plurality of perforations 804 to cause the flame to flow through the perforations 804. For example, the controller 114 can be configured to cause the at least one flow control electrode 110 to selectively impede combustion fluid flow through a portion of the perforations 804 corresponding to a fuel turn-down. For example, the controller 114 can be configured to cause the at least one flow control electrode 110 to selectively allow and/or attract combustion fluid to flow through all or a portion of the perforations 804 proportional to a fuel flow rate.

According to embodiments, the charge polarity placed on fuel, air, flame, or other combustion fluid flow by the charge generator(s) 102 can include an alternating charge. The flow control electrode(s) 110 can operate similarly to the description above by placing an in-phase voltage on the flow control electrode(s) 110 to reduce flow through the perforations 804 in the flame holder 802, or by placing an approximately 180° out-of-phase voltage on the flow control electrode(s) 110 to increase flow through the perforations 804 in the flame holder 802.

Figure 9:
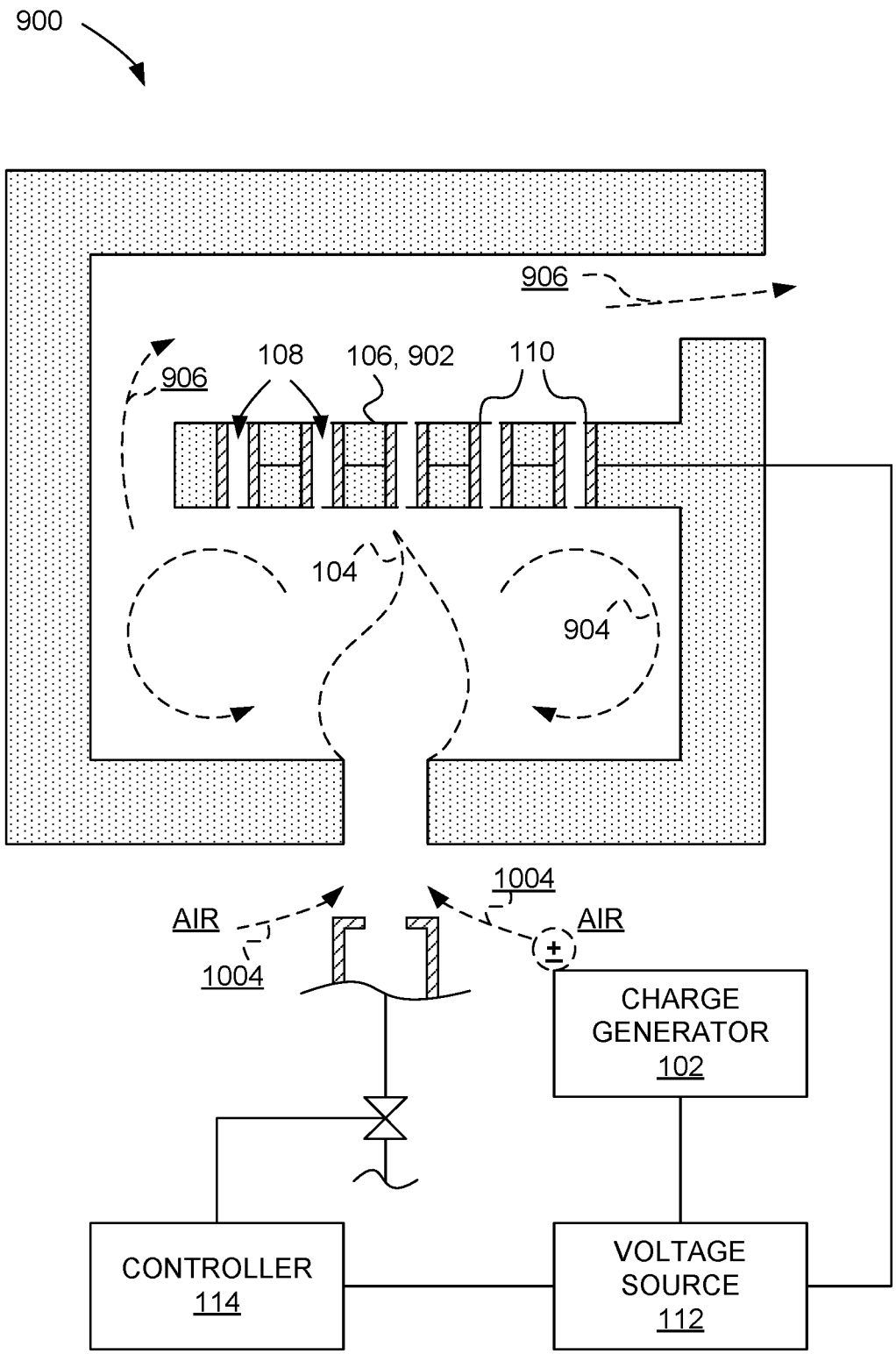
FIG. 9 is a diagram of a combustion fluid flow barrier formed as an exhaust gas recirculation (EGR) barrier, according to an embodiment.

FIG. 9 is a sectional diagram of a combustion fluid flow barrier 106 formed as an exhaust gas recirculation (EGR) barrier 902 configured to selectively recycle flue gases 904 from a combustion reaction 104, according to an embodiment 900. The aperture 108 can include a plurality of apertures 108 defined by the EGR barrier 902. A controller 114 can be configured to cause the flow control electrode 110 to selectively impede combustion fluid flow through the plurality of apertures 108 to cause the EGR barrier 902 to increase a proportion of flue gases 904 recycling to the combustion reaction 104. Similarly, the controller 114 can be configured to cause the flow control electrode 110 to selectively allow and/or attract combustion fluid flow through the plurality of apertures 108 to reduce the portion of flue gases 904 recycled to the combustion reaction 104. The controller 114 can be configured to cause the at least one flow control electrode 110 to selectively impede combustion fluid flow through a portion of the apertures 108 corresponding to a fuel turn-down, to selectively allow combustion fluid flow through a portion of the apertures 108 proportional to a fuel flow rate, and/or selectively attract combustion fluid flow through a portion of the apertures 108 proportional to a fuel flow rate.

According to embodiments, the charge polarity placed on the primary combustion reaction by the charge generator(s) 102 can include an alternating charge. The flow control electrode(s) 110 can operate similarly to the description above by placing an in-phase voltage on the flow control electrode(s) 110 to decrease exhaust gases 906 penetrating the EGR barrier 902 to increase the portion of recycled flue gases 904. Similarly, placing an approximately 180° out-of-phase voltage on the flow control electrode(s) 110 will increase exhaust gas 906 flow through the EGR barrier 902 to decrease the portion of recycled flue gases 904.

Figure 10:
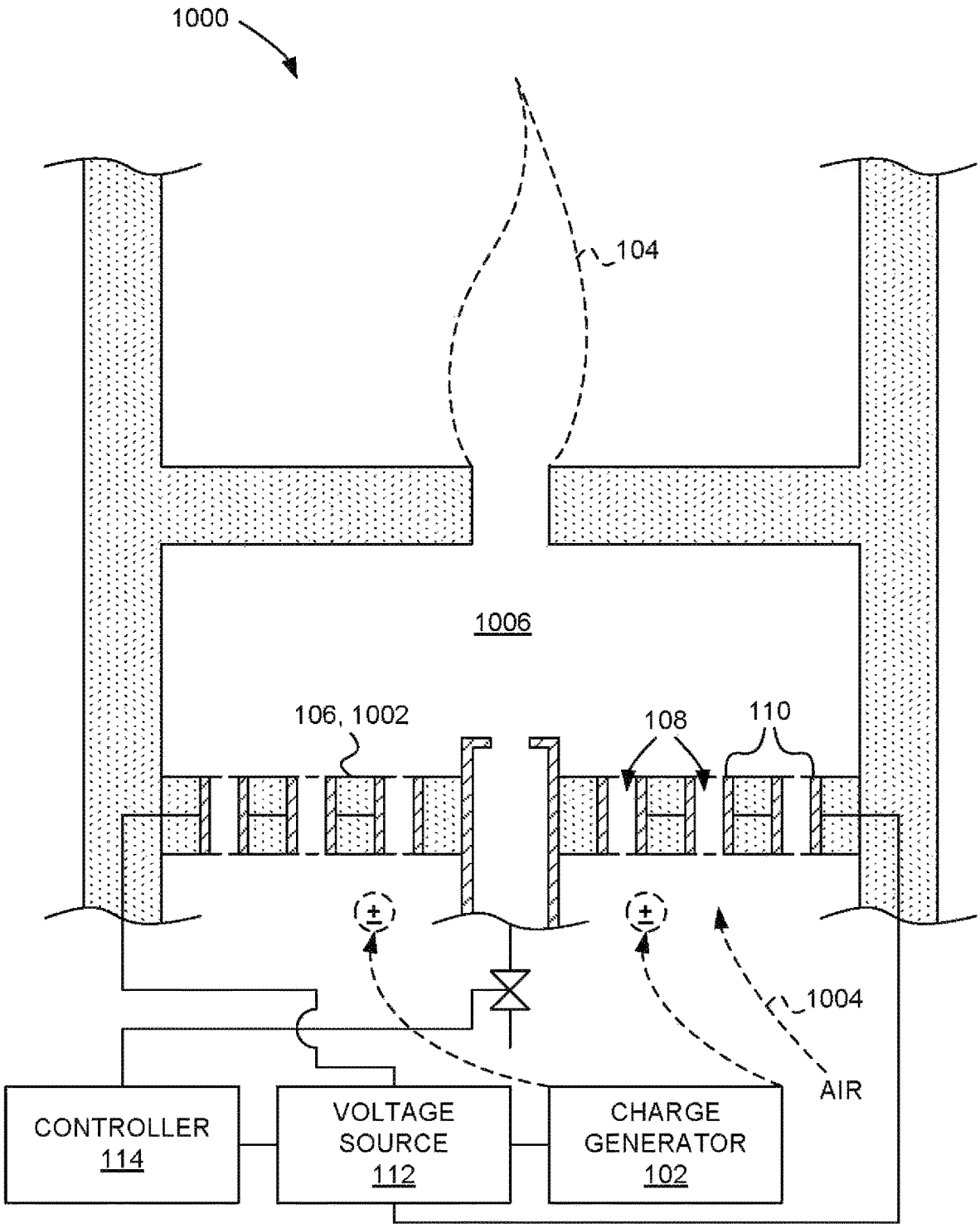
FIG. 10 is a diagram of a combustion fluid flow barrier formed as a combustion air damper, according to an embodiment.

FIG. 10 is a sectional diagram of a combustion fluid flow barrier 106 including a combustion air damper 1002 configured to select a rate of combustion air flow 1004 to a combustion reaction 104, according to an embodiment 1000. The at least one aperture 108 can include a plurality of apertures 108 defined by the combustion air damper 1002. A controller 114 can be configured to cause the at least one flow control electrode 110 to selectively impede combustion air flow through the plurality of apertures 108 to cause the combustion air damper 1002 to reduce the rate of combustion air flow 1004 to the combustion reaction 104. Similarly, the controller 114 can be configured to cause the at least one flow control electrode 110 to selectively allow or attract combustion fluid (combustion air) flow through the plurality of apertures 108 to cause the combustion air damper 1002 to increase a rate of combustion air flowing to the combustion reaction 104. Additionally or alternatively, the controller 114 can be configured to cause the at least one flow control electrode 110 to selectively impede, allow, or attract combustion air flow through a portion of the apertures 108 corresponding to a fuel turn-down. According to an embodiment of the system 1000 (as illustrated in FIG. 10), the flow control electrode(s) 110 can be configured to control a flow of combustion air (or (not shown) gaseous fuel) into a mixing volume 1006 of a premixer configured to support a premixed combustion reaction 104.

As with the embodiments described above, the charge polarity placed in the combustion air by the charge generator (s) 102 can include an alternating charge. The flow control electrode(s) 110 can operate similarly to the description above by placing an in-phase voltage on the flow control electrode(s) 110 to decrease combustion air flow through the combustion air damper 1002, or by placing an approximately 180° out-of-phase voltage on the flow control electrode(s) 110 to increase combustion air flow through the combustion air damper 1002.

Figure 11:
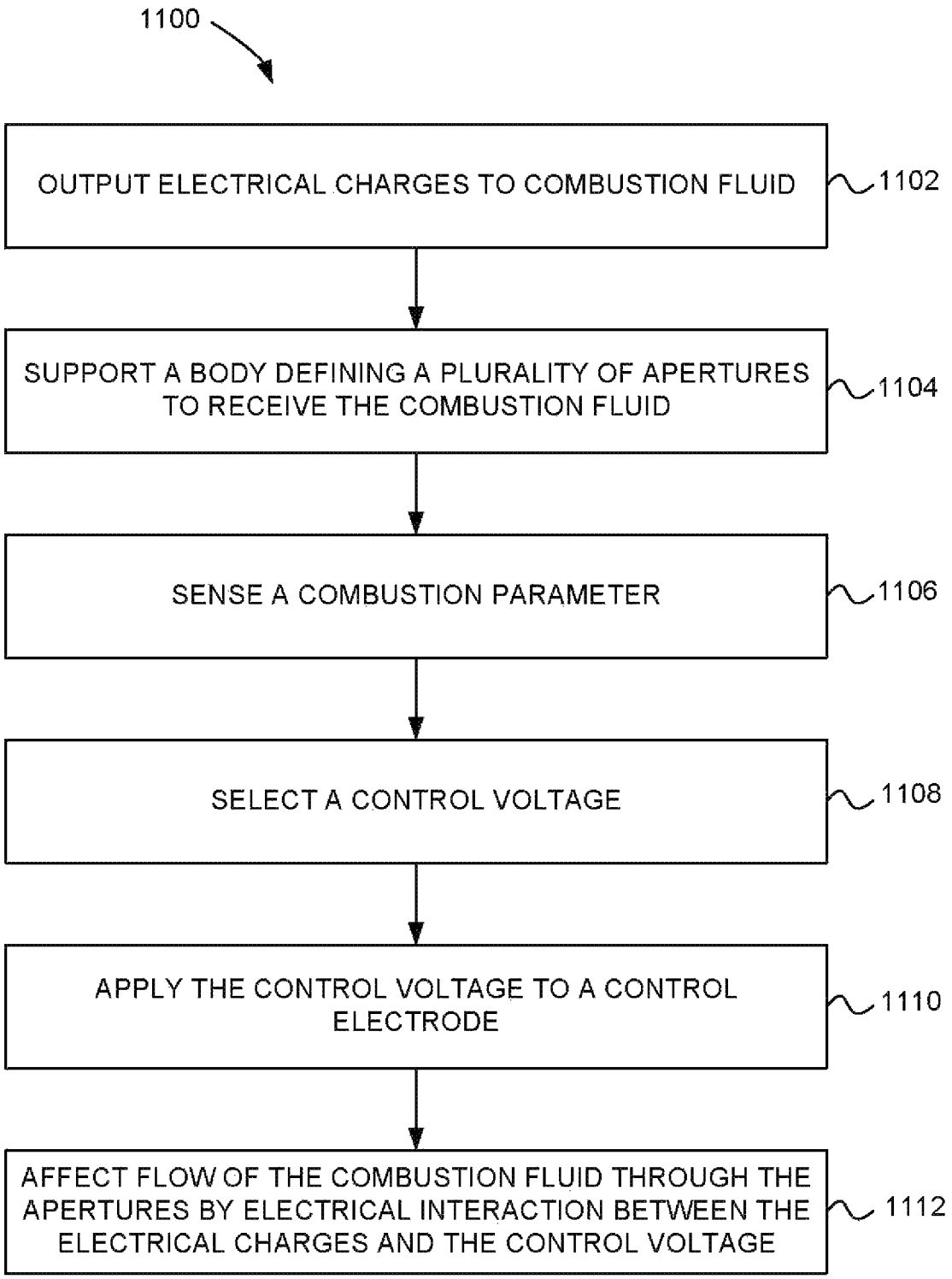
FIG. 11 is a flow chart showing a method for electrically controlling combustion fluid flow, according to an embodiment.

FIG. 11 is a flow chart showing a method 1100 for electrically controlling combustion fluid flow, according to an embodiment. Beginning at step 1102, electrical charges are output to a combustion fluid to form a charged combustion fluid. Proceeding to step 1104 a body is supported defining a plurality of apertures aligned to receive a flow of the charged combustion fluid. Proceeding to step 1110, a control voltage is applied to a control electrode disposed adjacent to the plurality of apertures. Finally, in step 1112, a flow of the charged combustion fluid through the plurality of apertures is affected with an electrical interaction between the charged combustion fluid and the control voltage carried by the control electrode.

Outputting electrical charges into a combustion fluid in step 1102 can include emitting charges with a corona electrode into a non-conductive combustion fluid. For example, the charges can be emitted into fuel, air, or a fuel and air mixture upstream from the apertures and control electrode. According to another embodiment, outputting electrical charges into a combustion fluid includes conducting charges from a charge electrode into a conductive combustion fluid. For example a charge generator can include a charge electrode that is in contact with a flame. Flames are relatively conductive.

The charged combustion fluid can include a fuel mixture, such as a fuel and air mixture. The charged combustion fluid can additionally or alternatively include a flue gas. The charged combustion fluid can additionally or alternatively include combustion air. The charged combustion fluid can additionally or alternatively include a flame.

As described above, various control scenarios are contemplated.

In one embodiment, outputting electrical charges to the combustion fluid includes outputting electrical charges having a first polarity and applying a control voltage to the control electrode includes applying a voltage at a second polarity the same as the first polarity. Affecting a flow of the charged combustion fluid through the plurality of apertures with an electrical interaction between the charged combustion fluid and the control voltage carried by the control electrode can include electrostatically repelling the electrical charges from the control electrode to attenuate the flow of charged combustion fluid through the apertures.

In another embodiment, outputting electrical charges to the combustion fluid includes outputting electrical charges having a first polarity and applying a control voltage to the control electrode comprises applying a voltage at a second polarity opposite to the first polarity. Affecting a flow of the charged combustion fluid through the plurality of apertures with an electrical interaction between the charged combustion fluid and the control voltage carried by the control electrode can include electrostatically attracting the electrical charges to the control electrode to enhance the flow of charged combustion fluid through the apertures.

In another embodiment, outputting electrical charges to the combustion fluid includes outputting electrical charges having a first polarity and applying a control voltage to the control electrode includes applying a voltage ground to the control electrode. Affecting a flow of the charged combustion fluid through the plurality of apertures with an electrical interaction between the charged combustion fluid and the control voltage carried by the control electrode can include electrostatically attracting the electrical charges to the control electrode to enhance the flow of charged combustion fluid through the apertures.

The method 1100 can further include operating a voltage source to output the control voltage.

Optionally, the method 1100 can include step 1106, wherein a combustion parameter is sensed. The method can also include step 1108, wherein the control voltage is selected responsive to the sensed combustion parameter. The control voltage can be set by controller and/or can be manually set by a system operator.

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. A method for electrically controlling combustion fluid flow, comprising:

outputting electrical charges to a combustion fluid to form a charged combustion fluid;

supporting a body defining a plurality of apertures aligned to receive a flow of the charged combustion fluid;

applying a control voltage to a flow control electrode disposed adjacent to the plurality of apertures;

affecting a flow of the charged combustion fluid through the plurality of apertures with an electrical interaction between the charged combustion fluid and the control voltage carried by the flow control electrode; and controlling the control voltage to cause the flow control electrode to selectively allow the flow of the charged combustion fluid through the plurality of apertures.

2. The method for electrically controlling combustion fluid flow of claim 1, wherein outputting electrical charges into a combustion fluid further comprises:

emitting charges with a corona electrode into a non-conductive combustion fluid.

3. The method for electrically controlling combustion fluid flow of claim 1, wherein outputting electrical charges into a combustion fluid further comprises:

conducting charges from a charge electrode into a conductive combustion fluid.

4. The method for electrically controlling combustion fluid flow of claim 1, wherein the charged combustion fluid comprises a fuel mixture.

5. The method for electrically controlling combustion fluid flow of claim 4, wherein the charged combustion fluid comprises a fuel and air mixture.

6. The method for electrically controlling combustion fluid flow of claim 1, wherein the charged combustion fluid comprises a flue gas.

7. The method for electrically controlling combustion fluid flow of claim 1, wherein the charged combustion fluid comprises combustion air.

8. The method for electrically controlling combustion fluid flow of claim 1, wherein the charged combustion fluid comprises a flame.

9. The method for electrically controlling combustion fluid flow of claim 1, wherein outputting electrical charges to the combustion fluid comprises outputting electrical charges having a first polarity;

wherein the applying of the control voltage to the flow control electrode comprises applying a voltage at a second polarity the same as the first polarity; and wherein the affecting the flow of the charged combustion fluid comprises electrostatically repelling the electrical charges from the flow control electrode to attenuate the flow of charged combustion fluid through the apertures.

10. The method for electrically controlling combustion fluid flow of claim 1, wherein outputting electrical charges to the combustion fluid comprises outputting electrical charges having a first polarity;

wherein the applying of the control voltage to the flow control electrode comprises applying a voltage at a second polarity opposite to the first polarity; and wherein the affecting the flow of the charged combustion fluid through the plurality of apertures comprises electrostatically attracting the electrical charges to the flow control electrode to enhance the flow of charged combustion fluid through the apertures.

11. The method for electrically controlling combustion fluid flow of claim 1, wherein the outputting of the electrical charges to the combustion fluid comprises outputting electrical charges having a first polarity;

wherein the applying of the control voltage to the flow control electrode comprises applying a voltage ground to the flow control electrode; and wherein the affecting the flow of the charged combustion fluid comprises electrostatically attracting the electrical charges to the flow control electrode to enhance the flow of charged combustion fluid through the apertures.

12. The method for electrically controlling combustion fluid flow of claim 1, further comprising:

operating a voltage source to output the control voltage.

13. The method for electrically controlling combustion fluid flow of claim 1, further comprising:

sensing a combustion parameter; and selecting the control voltage responsive to the sensed combustion parameter.

* * * * *